US006659466B2

(12) United States Patent
Searles et al.

(10) Patent No.: US 6,659,466 B2
(45) Date of Patent: Dec. 9, 2003

(54) THROWING GAME AND GOAL THEREFOR

(76) Inventors: Michael Searles, 149 S. High St., Globe, AZ (US) 85501; Denise M. Searles, 149 S. High St., Globe, AZ (US) 85501

( * ) Notice: Subject to any disclaimer, the term of this patent is extended or adjusted under 35 U.S.C. 154(b) by 0 days.

(21) Appl. No.: 09/849,130

(22) Filed: May 4, 2001

(65) Prior Publication Data

US 2002/0163132 A1 Nov. 7, 2002

(51) Int. Cl.[7] ..... A63B 63/00; A63B 67/06
(52) U.S. Cl. ..... 273/400; 273/407
(58) Field of Search ..... 273/398–402, 273/197, 476, 478, 485, 172, 195, 456

(56) References Cited

U.S. PATENT DOCUMENTS

| | | | | | |
|---|---|---|---|---|---|
| 1,211,379 | A | * | 1/1917 | Maisch | 273/368 |
| 1,923,152 | A | * | 8/1933 | Kohn | 273/394 |
| 2,126,102 | A | * | 8/1938 | Fowler | 473/456 |
| 3,929,334 | A | * | 12/1975 | Magazzu | 473/195 |
| 4,373,734 | A | | 2/1983 | Frank | |
| 4,809,988 | A | | 3/1989 | Hunter | |
| 5,096,191 | A | * | 3/1992 | Fang | 273/400 |
| 5,330,199 | A | * | 7/1994 | Vand | 273/400 |
| 5,941,529 | A | * | 8/1999 | Kinsey | 273/401 |
| 5,944,318 | A | * | 8/1999 | Payton | 273/402 |

FOREIGN PATENT DOCUMENTS

| | | | |
|---|---|---|---|
| FR | 2651141 | * | 8/1989 |
| GB | 2050177 | * | 1/1981 |

* cited by examiner

*Primary Examiner*—Mark S. Graham
(74) *Attorney, Agent, or Firm*—Birdwell, Janke & Durando, PLC

(57) ABSTRACT

A throwing game and goal therefor. At least two skeletal frame members and netlike coverings therefor are provided. Each of the skeletal frame members defines a frontal area encompassed by the respective covering. The frontal area encompassed by one of the skeletal frame members is less than the frontal area encompassed by the other skeletal frame member, and the two skeletal frame members are substantially overlappingly disposed with respect to each other so that the respective netlike coverings form higher point and a lower point goal zones.

16 Claims, 2 Drawing Sheets

THROWING GAME AND GOAL THEREFOR

BACKGROUND OF THE INVENTION

The present invention relates to a throwing game and goal therefor.

There is no end to people's desire to have fun and play new games, and outdoor games that can be played within a limited space are always popular. One particularly popular outdoor game involves throwing flying disks commonly known under the trademark FRISBEE, of Wham-O, Inc., San Francisco, Calif. In a basic form of the game, the disks are thrown or tossed between two or more persons spaced, typically, hundreds of feet away from one another, requiring a relatively large amount of space.

Some games employ the flying disc in conjunction with a playing field and two or more goals, such as that described in U.S. Pat. No. 4,373,734. The goals are formed of a skeletal frame which may include a netlike cover. A disadvantage of this game is that it also requires a relatively large amount of space as well as a number of persons to play.

Accordingly, there is a need for a novel throwing game and goal therefor that provides for throwing spinning disks by one or more persons in a limited amount of space at a netlike target.

SUMMARY OF THE INVENTION

The game and goal therefor of the present invention solves the aforementioned problems and meets the aforementioned needs by providing a goal for a throwing game comprising at least two skeletal frame members and netlike coverings therefor. Each of the skeletal frame members defines a frontal area encompassed by the respective covering. The frontal area encompassed by one of the skeletal frame members is less than the frontal area encompassed by the other skeletal frame member, and the two skeletal frame members are substantially overlappingly disposed with respect to each other so that the respective netlike coverings form higher point and a lower point goal zones. The higher point goal zone is defined by all or part of the netlike covering of the smaller skeletal frame member and the lower point goal zone is defined by frontal area of the netlike covering of the other skeletal frame member that is not frontally blocked by the smaller skeletal frame member and its netlike covering.

Preferably, the two skeletal frame members are separately supported so that they can move relative to one another. Preferably, the smaller skeletal frame member is connected to the larger frame member by two or more elongate flexible members, and the larger skeletal frame member is connected to two spaced apart standards by similar elongate flexible members. Preferably, the netlike coverings are substantially larger in area than the areas defined by the respective skeletal frame members so that the netlike coverings are substantially loose fitting, to permit the netlike coverings to capture and hold an object hitting the netlike coverings. Preferably, the object is a flying disk.

Therefore, it is a principal object of the present invention to provide a novel and improved throwing game and goal therefor.

It is another object of the present invention to provide a throwing game and goal therefor that provides for throwing spinning disks by one or more persons in a limited space.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
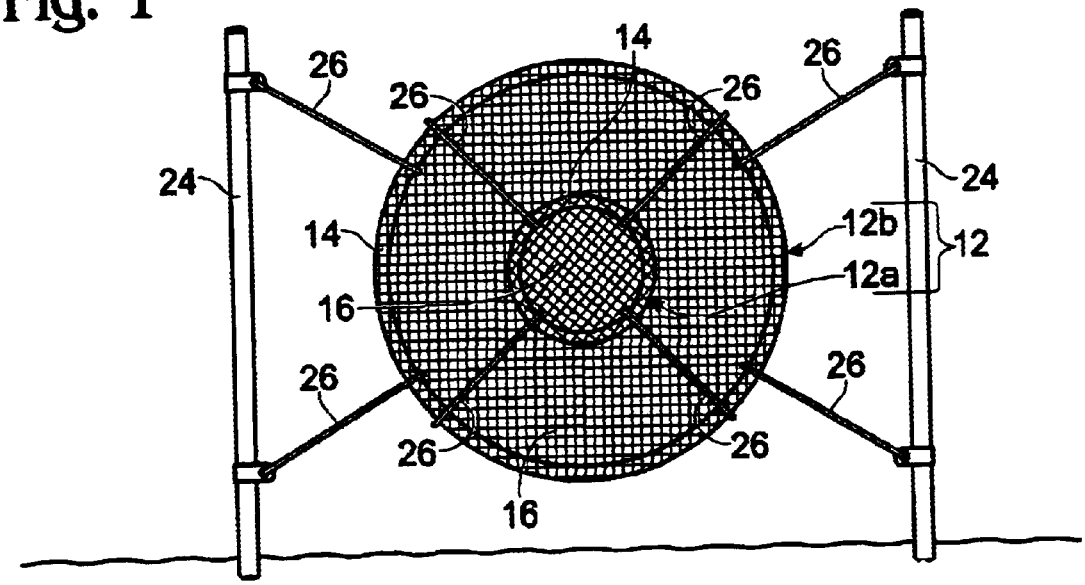
FIG. 1 is a front view of a goal for a throwing game according to the present invention.

Referring to FIG. 1, a goal 10 for a throwing game according to the present invention is shown. The goal is preferably used as a target for flying disks; however, the goal may be used as a target for any object. For purposes herein, the word "throw" is intended in its most general sense.

The goal comprises two or more goal units 12, each unit including a skeletal frame member 14 and a netlike covering 16 for the skeletal frame member. The netlike covering is preferably a netting material; however any flexible sheetlike material may be employed, so long as any apertures therethrough are smaller than the dimensions of the thrown object, so that the object will not pass through the netlike covering.

The skeletal frame members may be conveniently formed of plastic pipe sections joined by suitable pipe joint connectors; however, for mass production it may be preferable to form or mold the skeletal frame members integrally.

Figure 2:
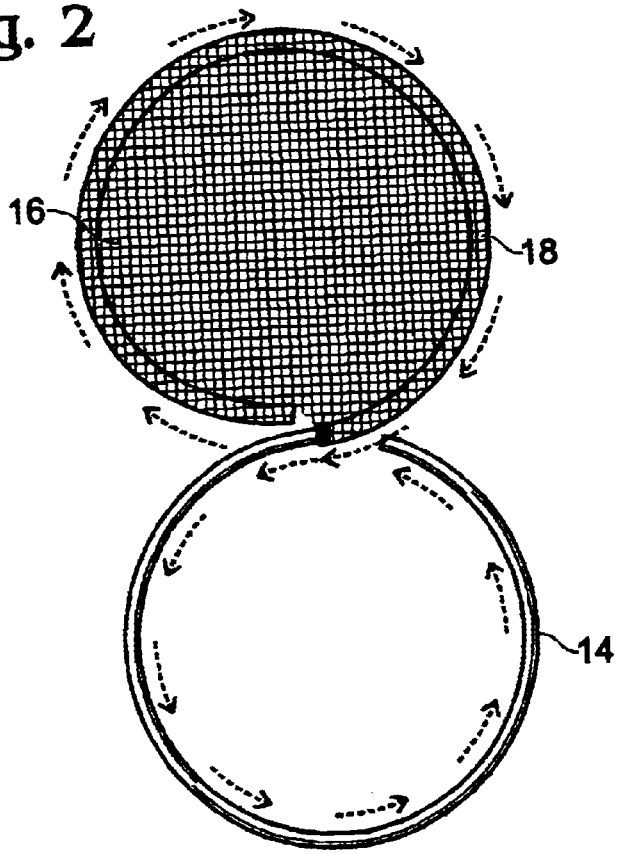
FIG. 2 is a front view of one unit of the goal of FIG. 1 shown in a stage of assembly according to the present invention.

The netlike coverings 16 may be applied to the skeletal frame members as shown in FIG. 2, wherein the skeletal frame member is threaded through a hollow seam 18 formed in the netlike covering.

Figure 3A:
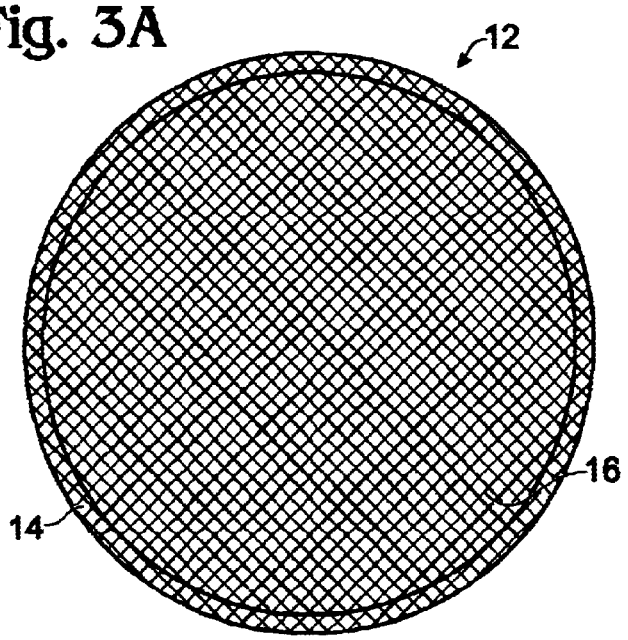
FIG. 3A is a front view of the unit of FIG. 2 after assembly.
Figure 3B:
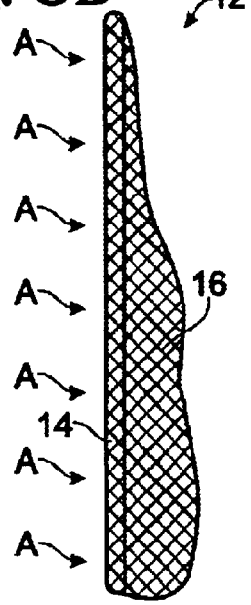
FIG. 3B is a side view of the unit of FIG. 3A.

Referring to FIGS. 3A and 3B, one of the units 12 is shown in a frontal aspect and an orthogonal side aspect respectively. In FIG. 3A, the netlike covering 16 as supported by the skeletal frame member 14 defines a frontal area "A" encompassed thereby, which for a 4 foot diameter circularly formed skeletal member is $4\pi$.

Turning back to FIG. 1, one of the units 12*a* is overlappingly disposed with respect to the other unit 12*b* when viewed in the frontal aspect (hereinafter "frontally overlappingly disposed"). Preferably, the units 12 are circularly formed and are frontally overlappingly concentrically disposed as shown; however, neither of these features are essential to the invention.

Figure 4:
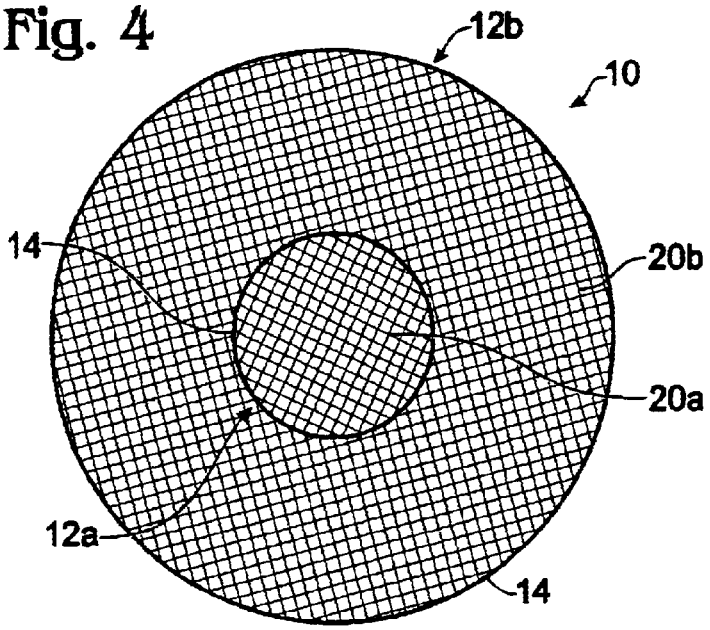
FIG. 4 is a schematized view of the goal of FIG. 1 showing goal zones according to the present invention.

With additional reference to FIG. 4, one of the units 12*a* has a smaller frontal area than the other, so that in the aforementioned disposition, two goal zones 20*a*, 20*b* are formed. Where there are just two units 12, one of the goal zones 20*a* is defined by the frontal area of the smaller unit 12*a*. As this is preferably centrally located in the goal 10, the goal zone 20*a* may be considered, in a similar manner to a dartboard, as being a relatively high point target and may be sized accordingly, e.g., by being relatively small compared to the size of the goal zone 20*b*.

A portion (not visible) of the frontal area of the larger unit 12*b* is blocked ("frontally blocked") by the frontal area of the smaller unit 12*a*, and another portion 22 of the frontal area of the larger unit is not blocked by the smaller unit 12*a* and is therefore available as the goal zone 20*b*. The goal zone 20*a* may be considered a relatively low point target.

Referring back to FIGS. 2 and 3B, the netlike coverings 14 are preferably provided with larger frontal areas than are defined by the respective skeletal members 16. This provides for a sag or looseness (see FIG. 3B) in the netlike coverings as supported by the skeletal members so that an object hitting one of the goal zones and therefore one of the netlike coverings will be less inclined to bounce from the goal and will tend to be captured by the goal, the netlike covering forming a pocket around the object for receiving the object. This provides each goal zone with the capability to separately collect the objects hitting the goal zone, which clarifies whether a goal has been made and facilitates keeping score.

The skeletal frame members 14 with their respective netlike coverings 16 are supported in an upright position as shown in FIG. 1 by spaced apart standards 24. Most economically, the standards are simple stakes driven into the ground; however, the standards may be provided to set on the ground or some other surface, and may be integral parts of a larger structure provided to support the goal.

The larger skeletal frame member is preferably attached to the standards, and the smaller skeletal frame member is preferably attached to the larger skeletal frame member, by elongate flexible members 26. The members 26 may be, e.g., ropes, cords or chains, but are preferably elastic cords known conventionally as shock or bungee cords. The responsive movement of the units, as a result of being hit by the object, accommodated by the elastic cords minimizes risk of damage to the goal and increases its longevity.

Preferably, there are two flexible members 26 connecting the larger skeletal member 12*b* to one of the standards 24 and two of the flexible members connecting the member 12*b* to the other standard. Preferably as well, there are four of the flexible members 26 connecting the skeletal member 12*a* to the skeletal member 12*b* as shown in FIG. 1. Further, the flexible members 26 preferably connect to the skeletal members at intervals of substantially equal arc lengths as shown, to support the skeletal members with optimum stability.

According to a game for which the aforedescribed goal is supplied according to the present invention, a player stands a predetermined distance from the goal and throws an object, preferably a flying disc, at the goal. The player ideally aims for the higher point goal zone 20*a* and, if the player hits that goal zone with the object, the player is awarded a predetermined number of points. If the player misses the higher point goal zone 20*a* and hits, instead, the lower point goal zone 20*b*, the player is awarded a predetermined lesser number of points. The rules of the game may provide that a score is not counted if the object is not retained by the goal. The goal may be provided with additional goal zones and therefore additional scoring opportunities with suitable modifications that will be readily apparent to those of ordinary skill in light of the description provided above.

It is to be recognized that, while a particular throwing game and goal therefor has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. A goal for a throwing game, comprising:

a first circular skeletal frame having a first netlike covering and defining a first frontal area encompassed by said covering;

a second circular skeletal frame having a second netlike covering and defining a second frontal area encompassed by said second netlike covering, wherein said first and second netlike coverings are distinct from one another, said second frontal area being smaller than said first frontal area and said second skeletal frame being frontally overlappingly disposed with respect to said first skeletal frame so that a first portion of said first frontal area is not frontally blocked by said second netlike covering and so that a second portion of said first frontal area is frontally blocked by said second netlike covering, to form a goal having a first goal zone defined by said first portion and a second goal zone defined by said second portion; and at least two standards and at least two elongate flexible members, one of said elongate flexible members connecting said first skeletal frame to one of said standards and the other of said elongate flexible members connecting said first skeletal frame to another of said standards.

2. The goal of claim 1, wherein said elongate flexible members are formed of elastic cord material.

3. The goal of claim 1, wherein there are at least four elongate flexible members, each connecting said first skeletal frame to the respective said standards.

4. The goal of claim 1, wherein there are at least two elongate flexible members connecting said first and second skeletal frames.

5. The goal of claim 4, wherein said elongate flexible members are formed of elastic cord material.

6. The goal of claim 5, wherein there are at least four elongate flexible members connecting between said first and second skeletal frames.

7. The goal of claim 6, wherein there are at least four elongate flexible members, each connecting said first skeletal frame to the respective said standards at intervals of substantially equal arc lengths of said first skeletal frame.

8. The goal of claim 7, wherein said elongate flexible members are formed of elastic cord material.

9. The goal of claim 1, wherein the throwing game includes a flying disc for throwing toward the goal.

10. A goal for a throwing game, comprising:

a first skeletal frame having a first netlike covering and defining a first frontal area encompassed by said covering;

a second skeletal frame having a second netlike covering and defining a second frontal area encompassed by said second netlike covering, wherein said first and second netlike coverings are distinct from one another, said second frontal area being smaller than said first frontal area and said second skeletal frame being frontally overlappingly concentrically disposed with respect to said first skeletal frame so that a first portion of said first frontal area is not frontally blocked by said second netlike covering and so that a second portion of said first frontal area is frontally blocked by said second netlike covering, to form a goal having a first goal zone defined by said first portion and a second goal zone defined by said second portion; and at least two standards and at least two elongate flexible members, one of said elongate flexible members connecting said first skeletal frame to one of said standards and the other of said elongate flexible members connecting said first skeletal frame to another of said standards.

11. The goal of claim 10, wherein said flexible elongate members are formed of elastic cord material.

12. The goal of claim 10, wherein there are at least four elongate flexible members, each connecting said first skeletal frame to the respective said standards.

13. The goal of claim 10, wherein there are at least two elongate flexible members connecting said first and second skeletal frames.

14. The goal of claim 13, wherein said elongate flexible members are formed of elastic cord material.

15. The goal of claim 13, wherein there are at least four elongate flexible members connecting between said first and second skeletal frames.

16. The goal of claim 10, wherein the throwing game includes a flying disc for throwing toward the goal.

* * * * *